US007437828B1

(12) United States Patent
Rozmiarek

(10) Patent No.: US 7,437,828 B1
(45) Date of Patent: Oct. 21, 2008

(54) SIDING ADJUSTABLE ANGLE INSTALLATION APPARATUS

(76) Inventor: Kenneth C. Rozmiarek, North 12989 Harper Rd., Silver Cliff, WI (US) 54104

( * ) Notice: Subject to any disclaimer, the term of this patent is extended or adjusted under 35 U.S.C. 154(b) by 175 days.

(21) Appl. No.: 11/595,178

(22) Filed: Nov. 9, 2006

Related U.S. Application Data

(60) Provisional application No. 60/734,437, filed on Nov. 9, 2005.

(51) Int. Cl.
*B43L 13/00* (2006.01)

(52) U.S. Cl. ..... 33/562; 33/416; 33/452

(58) Field of Classification Search ..... 33/562–566, 33/42, 504, 416–418, 421, 452
See application file for complete search history.

(56) References Cited

U.S. PATENT DOCUMENTS

| | | | | | |
|---|---|---|---|---|---|
| 2,214,870 | A * | 9/1940 | West | ..... | 83/455 |
| 4,095,500 | A * | 6/1978 | Rouse | ..... | 83/762 |
| 4,903,409 | A | 2/1990 | Kaplan et al. | | |
| 5,203,090 | A | 4/1993 | Bouska et al. | | |
| 5,249,495 | A | 10/1993 | Renk | | |
| 5,251,524 | A * | 10/1993 | Clifford | ..... | 83/383 |
| D363,013 | S | 10/1995 | Hunter | | |
| D386,663 | S | 11/1997 | Kehres et al. | | |
| 6,240,764 | B1 | 6/2001 | Geurts | | |
| 6,334,259 | B1 | 1/2002 | Harvey | | |
| 7,251,902 | B1 * | 8/2007 | Mueller | ..... | 33/562 |
| 2002/0059857 | A1 * | 5/2002 | Eanes | ..... | 83/564 |
| 2007/0175059 | A1 * | 8/2007 | Mueller | ..... | 33/562 |
| 2008/0022542 | A1 * | 1/2008 | Brosmith et al. | ..... | 33/562 |

* cited by examiner

*Primary Examiner*—Yaritza Guadalupe-McCall
(74) *Attorney, Agent, or Firm*—Robert C. Montgomery

(57) ABSTRACT

The present invention comprises an apparatus and method for accurately and safely cutting residential siding members. A specialized tool and saw guide system comprise two hingedly connected plates to securely hold and balance the siding member during the cutting process, as well as resilient saw guides for guiding a saw blade. The device allows for both a straight edge cut and an angled cut to match a conventional roof pitch. Additional embodiments are anticipated to provide for various angled cuts.

18 Claims, 3 Drawing Sheets

SIDING ADJUSTABLE ANGLE INSTALLATION APPARATUS

RELATED APPLICATIONS

The present invention was first described in U.S. Provisional Patent Application No. 60/734,437, filed on Nov. 9, 2005.

FIELD OF THE INVENTION

The present invention relates generally to an apparatus and a method for accurately and safely cutting residential siding and, more particularly, to a specialized tool with a resilient saw guide system that results in straight edge cuts and angled cuts to conform with roof pitches

BACKGROUND OF THE INVENTION

As any professional contractor will attest, nothing beats having the proper tool for a job. The proper tool can save time, save money, produce a higher quality job, reduce damage to equipment, and provide for the increased safety of the worker. Each field of construction or contracting work has its own type of specialty tools, each performing a specialized task. One field where such a need exists is that of vinyl siding installation. While, at first, installation of vinyl siding may seem straightforward and uncomplicated, there are many cuts that must be made at precise angles so that the finished installation looks aesthetically pleasing. Many contractors use simple straight edges and circular saws, which provide for quick, burr-free cuts, but often result in cracked siding or cuts with chunks missing, due to the fact that the siding is not fully supported during the cutting process. The cut must then be remade, which not only results in wasted time, but wasted material as well. The development of this apparatus and system fulfills this need.

The invention consists of two metal plates connected by a hinge or series of hinges along one edge. A piece of vinyl siding is placed between the metal plates, and the plates are then closed together forming a "sandwich" of vinyl siding. One end of the plate is cut at a 90° angle, forming a straight cut. The other end would be cut to match the roof pitch, which is one of the most common cuts made to vinyl siding along the roof line. Then, a circular saw with the appropriate blade is run along the desired edge in a guide system on the upper plate of the invention. This method assures that the cut will be extremely true and accurate, while eliminating the possibility of cracked or gouged siding, since it is securely supported on all edges. The invention would be available in multiple models to match the most common roofline pitches such as 4/12 (drop of four inches per running foot), 6/12, or 8/12. This apparatus and system provides a safe and efficient means of cutting with a circular saw on the job site to match various roof pitches.

Several attempts have been made in the past to provide a device that constantly and accurately measures and cuts structural siding members at various angles. U.S. Pat. No. 5,249,495, issued in the name of Renk, discloses a shingle cutter apparatus including a rigid base plate, a cutter anvil, and a pivotal cutter blade mounted in cooperation with the anvil. Unfortunately, the Renk device does not provide any means to attach and guide a circular saw as in the present invention.

U.S. Pat. No. 6,334,259, issued in the name of Harvey, teaches a scoring tool for siding material and method of use, comprising an extensible measuring rail with a scoring knife attached thereto, wherein the rail and knife assembly interlocks with the siding material. The Harvey device differs from the present invention in that it does not retain the siding material within two hinged plates with marking and/or guide means for a circular saw to cut said siding material.

U.S. Pat. No. 4,903,409, issued in the name of Kaplan et al., describes a drywall scribing and scoring tool for a typical wallboard, wherein a knife-holding and scribe units are adjustably attached on an arm of a "T"-square member. The Kaplan et al. device also does not provide means to retain a siding material within hinged plates comprising fixed cutting angles and having means to guide a circular saw for cutting the siding material.

U.S. Pat. No. 6,240,764, issued in the name of Geurts, discloses a "J"-channel siding cutting tool used to cut tabs or notches or a miter finishing cut in "J"-channel vinyl or aluminum siding, comprising a pair of pivotable interconnected handles with two cutters and a biasing member for urging the handles apart and separating the cutters at the at-rest position, and a travel limiter. The Geurts device is designed to be held in the hands of a user to cut specifically styled siding by hand and does not have the features or benefits of the present invention.

U.S. Pat. No. 5,203,090, issued the in name of Bouska et al., teaches a siding layout and tool and method for making a longitudinal mark on, or cut through, a piece of siding. The Bouska et al. patent comprises an upper and lower plate portion with a step therebetween, adapted to fit onto a piece of siding. The two plates have a predetermined series of holes along the length of the tool, wherein a marking tool and/or a knife can be inserted through to scribe or cut the siding. Unfortunately, the Bouska et al. device does not have means to guide a circular saw along an angled edge to cut the siding member as in the present invention.

Additionally, various patents have been issued concerned with the ornamental design of various siding cutter devices, notably D 386,663 issued in the name of Kehres et al. and D 363,013 issued in the name of Hunter.

None of the prior art particularly describes a device that guides a cutting instrument along resilient guide members wherein the siding member is "sandwiched" in between hinged plates. Accordingly, there exists a need for a means by which vinyl siding can be cut with a circular saw without the disadvantages listed above.

SUMMARY OF THE INVENTION

In view of the foregoing disadvantages inherent in the prior art, it has been observed that there is need of a device to assist in cutting siding.

It has further been observed that there is a need for a device that has a plurality of different sizes, based on common roof angles.

The object of the present invention is to provide a device, comprising two hingedly connected plates, preferably fabricated out of metallic or other resilient material, each comprising a first edge maintaining a 90° angle for straight cuts; a hinged edge; an open edge; and a second edge embodying varying angles most commonly matching that of conventional roof pitch angles to permit directing a cutter blade, said plates encompass a siding member for preparing a cut. Each plate has a lip formed about its hinged edge and open edge that abuts when both plates are hinged together, thereby forming an interior through which a siding member is placed. The length and width of the plates may vary in accordance to size of siding to be trimmed and the roof pitch, as well as other user preferences.

Another object of the present invention is to provide a first guide track, located on the front plate, running parallel to the open edge and a second guide track, located on the front plate, running parallel to the hinged edge.

Yet another object of the present invention is to provide a straight cut guide slidably engaged within the first guide track and a roof pitch cut guide slidably engaged within the second guide track. Each guide adjustably progresses longitudinally and/or slantingly at interval adjustments and is designed to assist in guiding a cutting instrument at a chosen angle.

Still yet another object of the present invention provides for a pair of resilient stops placed within opposing ends of each guide track to prevent the guides from unwanted slippage down each guide track, that is either fabricated with a non-slip frictional composition or mechanically affixed within each the guide track. The stops act as limiters, which assist in a smooth and continuous cutting operation without slippage of the guides upon operation.

Another object of the present invention provides a clasp, locking mechanism, fastener, catch, or other detachedly affixing mechanism mechanically situated at a center location of the open edges on each plate to fasten the plates together, while encompassing the siding member.

To achieve the above and other objectives, the present invention provides for a method of utilizing the aforementioned, comprising the steps of acquiring a siding member; measuring a desired angle and marking said angle on said siding member; opening the two opposing front and rear plates about the hinges; placing said siding member therewithin the interior; closing said plates together, thereby retaining said siding member therewithin such that said siding member extends longitudinally outward; slidably adjusting said straight cut guide until the blade of a cutting instrument comes into contact with said siding member; ensuring that both stops are in place to prevent slippage of said straight cut guide; cutting said siding member by guiding said cutting instrument along said straight cut guide; slidably adjusting said roof pitch cut guide to a desired pitch angle until the blade of said cutting instrument comes into contact with said siding member; ensuring that both stops are in place to prevent slippage of said roof pitch cut guide; and, cutting said siding member by guiding said cutting instrument along said roof pitch cut guide.

BRIEF DESCRIPTION OF THE DRAWINGS

The advantages and features of the present invention will become better understood with reference to the following more detailed description and claims taken in conjunction with the accompanying drawings, in which like elements are identified with like symbols and in which:

DESCRIPTIVE KEY

| | |
|---|---|
| 10 | siding adjustable angle cutting guide |
| 11 | front plate |
| 12 | hinge |
| 13 | cutting angle |
| 14 | guide track |
| 15 | straight cut guide |
| 16 | roof pitch cut guide |
| 17 | cut guide track stop |
| 20 | siding |
| 30 | rear plate |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
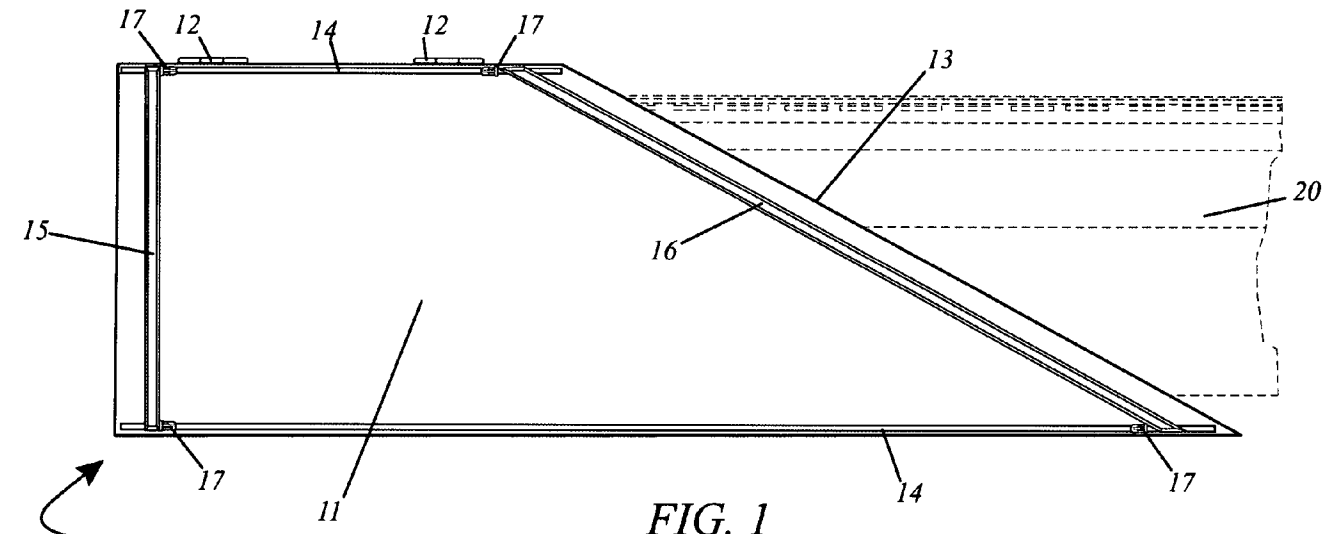
FIG. 1 is a top view of the siding adjustable angle installation device 10, according to a preferred embodiment of the present invention; and, FIG. 2 is a side view of the siding adjustable angle installation device 10, according to a preferred embodiment of the present invention; and, FIG. 3 is a perspective view of the siding adjustable angle installation device 10, according to a preferred embodiment of the present invention; and, FIG. 4 is a rear view of the siding adjustable angle installation device 10, according to a preferred embodiment of the present invention; and, FIG. 5 is a rear view of the siding adjustable angle installation device 10, according to a preferred embodiment of the present invention.

Referring now to FIG. 1, a siding adjustable angle cutting guide 10 (herein referred to as the "device") hingedly retains a piece of residential siding 20 therewithin to effect a level and straight cut for an individual piece of siding 20 during construction and installation of building materials, is herein disclosed. The device 10 is preferably fabricated of a metallic, plastic, or other suitable material using conventional die stamping and cutting techniques. The device 10 is preferably lightweight to accommodate bidirectional use by a user through operation with either hand.

Figure 2:
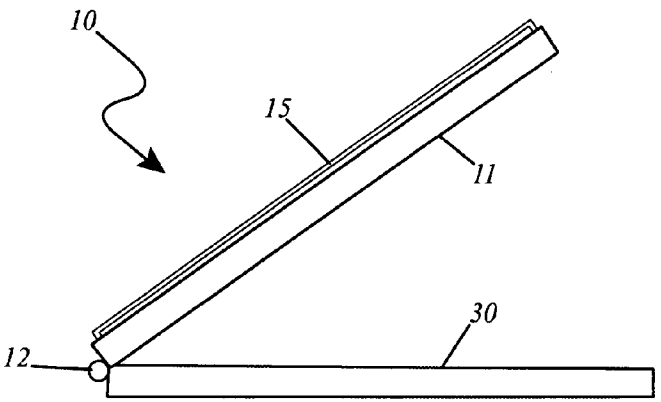
Figure 3:
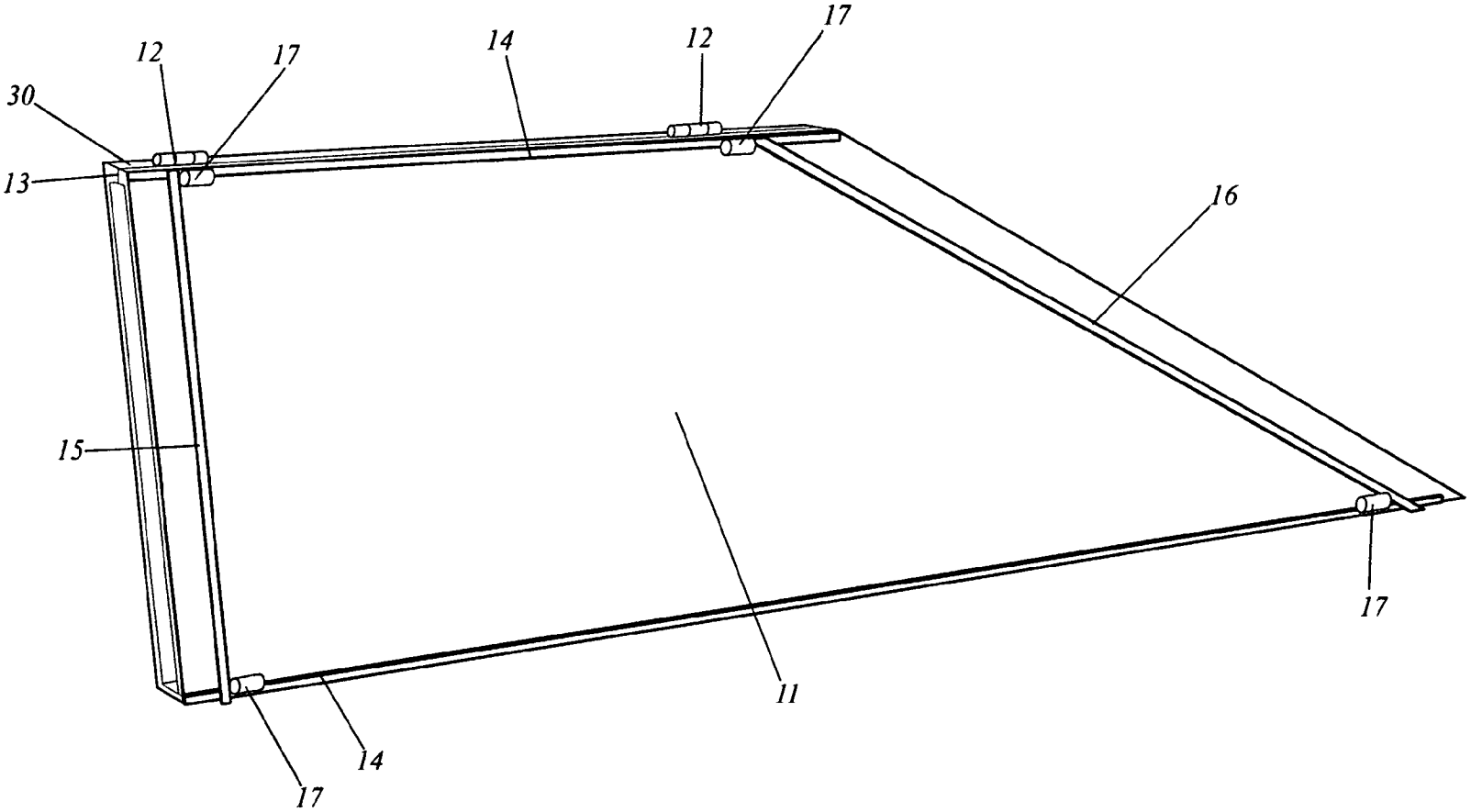

Referring now to FIGS. 2 and 3, views of the device 10 are disclosed according to a preferred embodiment of the present invention. The device 10 comprises two (2) similarly fabricated plates 11, 30, in the general shape of a trapezoid, comprising one (1) end maintaining a 90° angle for straight cuts and the opposite end 13 maintaining a different angle, most commonly matching that of conventional roof pitch angles to permit directing the cutter blade. The shape and degree of slope of the roof pitch edge 13 are variable depending upon the desired appearance or profile of the siding 20. It is contemplated that the length and width of plates 11, 30 may vary in accordance to the size of siding 20 to be trimmed and the roof pitch, as well as other user preferences.

Figure 4:
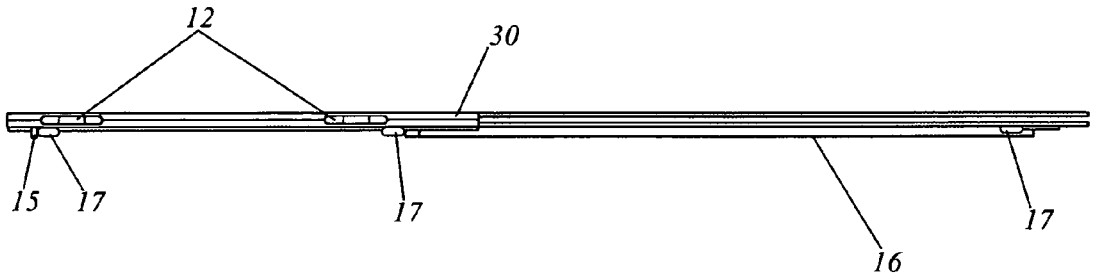
Figure 5:
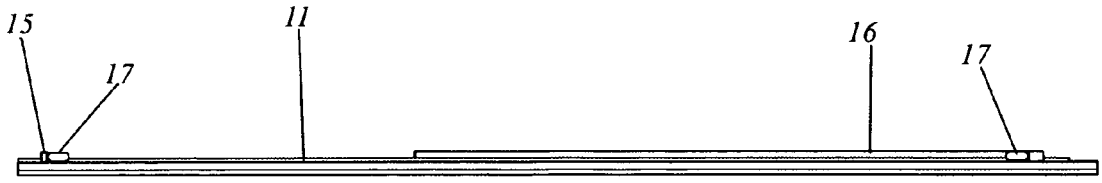

Referring now to FIGS. 4 and 5, front and rear views of the device 10 are disclosed according to the preferred embodiment of the present invention. The device 10 comprises two (2) plates 11, 30 hingedly connected at one (1) end thereof. In the closed orientation, the two (2) plates 11, 30 lie in substantially parallel planes, interconnected via hinges 12. The device 10 comprises a front plate 11 and a rear plate 30 that are attached to each other via hinges 12 on the edge perpendicular to the straight cut and roof pitch 13 edges. In this manner, the device 10 is adapted to receive the front and rear surfaces of the siding 20, much like sandwiching said siding 20, wherein the front plate portion 11 is placed against the front outer surface of the siding 20, and the rear plate portion 30 is placed against the rear surface of the siding 20. The hinge 12 provides a pivoting feature such that the front plate 11 may pivotally lift off of the rear plate 30 to permit the insertion or removal of the siding 20. The device 10 may then shut much like a clamshell and, thus being releaseably secured, thereby retaining the siding 20 desired to be cut. The plates 11, 30 pivotally close, having sufficient inner area dimensions to facilitate grasping of the siding 20 of varying thicknesses. The open sides of both the front 11 and rear plate 30 of the device 10 each have a lip that abuts with each other when the plates are brought together. Although it has been illustrated that the device 10 comprises two (2) hinges 12, it will be appreciated that the device 10 may have a plurality of hinges 12 equidistantly spaced.

Formed on the outer surface of one (1) plate 11 are grooves along the long edges to act as a guide track 14 to receive the straight cut guide 15 oriented near the straight cut edge and the roof pitch cut guide 16 oriented near the roof pitch cut edge. The guide tracks 14 are positioned along the long edges to correspondingly engage and mate with the guides 15, 16 and stops 17. Both guides 15, 16 slide back and forth through the formed guide tracks 14 and are manufactured out of a resilient material. The guides 15, 16 are movably and slidably received therein the guide tracks 14, thus permitting the guides 15, 16 to adjustably progress longitudinally and/or slantingly at interval adjustments as needed. Resilient stops 17 are placed within the guide tracks 14 to prevent the guides 15, 16 from unwanted slippage down the groove track 14, most typically fabricated with a non-slip frictional composition or mechanically affixed within the guide track 14 to accomplish the same task. The stops 17 are limiters that assist and enhance an individual's ability to quickly and consistently create cuts without slippage of the guides 15, 16 upon operation. The stops 17 are preferably adapted to engage the guide tracks 14 at the designated position for the desired cut, thereby preventing the guides 15, 16 from being moved an undesirable distance at an undesirable time. Therefore, the stops 17 assist in the smooth and continuous cutting operation by minimizing inadvertent guide 15, 16 slippage. It will be appreciated that the guide tracks 14, the guides 15, 16, and/or the stops 17 may be either on the front plate 11 and/or the rear plate 30 as is illustrated for comparison purposes only in FIGS. 1 and 3.

An alternate embodiment of the present invention may disclose a clasp, locking mechanism, fastener, catch, or other detachedly affixing mechanism, mechanically situated at the opposite center side portion of the hinges 12 to fasten the plates 11, 30 together while encompassing the siding 20 to be cut and/or trimmed.

Another alternate embodiment of the present invention may disclose other pivoting means such as a locking nut and bolt, pin, cotter pin, and/or any other sturdy pivotal affixation mechanism to meet the requirements of the functions, attributes, and features of the device 10.

The preferred embodiment of the present invention can be utilized by the common user who has little or no training in a simple and effortless manner. After initial purchase or acquisition of the device 10, it would be configured as indicated in FIGS. 1 through 5.

The present invention 10 provides an easy, accurate, and safe method for properly cutting vinyl, wood, or other building siding pieces 20 during construction or renovation. The proper use of the device 10 also prevents any undesirable gouging or cracking of the siding piece 20 due to uneven and unbalanced support during the cutting process. The device 10 is anticipated to be available in multiple models and sizes to match the desired cut for most conventional and customized roof lines. Also, the device 10 provides a means for cutting siding pieces 20 with a circular saw, which provides a safe, quick, and easy cutting method.

After measuring the angles and marking the siding piece 20, the user opens the two (2) opposing plates 11, 30 by the hinges 12 and places the piece of siding 20 that is desired to be cut. The plates 11, 30 are then closed, retaining the siding piece 20 therewithin, with the siding piece 20 extending outward 15 longitudinally. The straight edge guide 15 is then manipulated until the blade of a circular saw comes into contact with the siding piece 20, taking care to ensure that both stops 17 are in place to prevent slippage of the guide 15. The circular saw must be fitted with the proper blade to cut the particular piece of siding 20 chosen. Once the straight edge has been cut, the user moves the roof pitch edge guide 16 and stops 17 in a similar fashion to the straight edge guide 15 and proceeds to cut the desired roof pitch angle.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A device for retaining, measuring, and providing a cutting guide for a cutting instrument for a siding member comprising:

an upper plate, comprising a first straight edge, a first hinged edge, a first open edge with a first lip, a first roof pitch edge embodying a first varying angle, and a first width;

wherein said first open edge comprises a greater length than said first hinged edge;

a lower plate comprising a second straight edge, a second hinged edge, a second open edge with a second lip, a second roof pitch edge embodying a second varying angle, and a second width;

wherein said second open edge comprises a greater length than said second hinged edge;

an interior; and, at least one hinged connection, attached to said first hinged edge of said upper plate and said second hinged edge of said lower plate;

wherein said first lip and said second lip abut each other when said upper plate and said lower plate are conjoined thereby defining said interior, said interior encompasses said siding member to be cut.

2. The device of claim 1, wherein said lower plate is substantially identical in size and shape to said upper plate.

3. The device of claim 2, wherein said first width and said second width accommodates said siding member with either 8 inches in width or 10 inches in width.

4. The device of claim 3, wherein said first varying angle and said second varying angle is a conventional roof pitch angle.

5. The device of claim 4, wherein said upper plate further comprises a first guide track located on an outer surface running parallel to said first open edge and a second guide track located on said outer surface running parallel to said first hinged edge.

6. The device of claim 5, further comprising a straight cut guide slidably engaged within said first guide track and a roof pitch cut guide slidably engaged within said second guide track, wherein both said straight cut guide and said roof pitch cut guide adjustably progress independently at interval adjustments and are designed to assist in guiding said cutting instrument at said varying angle.

7. The device of claim 6, further comprising a first pair of resilient stops securably and adjustably placed within opposing ends of said first guide track and a second pair of resilient stops securably and adjustably placed within opposing ends of said second guide track, wherein said first pair of resilient stops and said second pair of resilient stops function to prevent said guides from unwanted slippage down said guide tracks.

8. The device of claim 7, wherein said first pair and said second pair of resilient stops are either fabricated with a non-slip frictional composition or with mechanical fasteners.

9. The device of claim 8, wherein said device further comprises a fastening mechanism situated at a center location of said first and second open edges to fasten said upper plate to said lower plate.

10. The device of claim 4, wherein said conventional roof pitch angle is 4/12, 6/12, or 8/12.

11. A device for retaining, measuring, and providing a cutting guide for a cutting instrument for a siding member comprising:

an upper plate, further comprising:
- a first straight edge;
- a first hinged edge;
- a first open edge with a first lip;
- a first roof pitch edge embodying a first varying angle, and a first width, wherein said first open edge comprises a greater length than said first hinged edge; and,
- an upper surface comprising:
  - a first guide track located on an outer surface running parallel to said first open edge;
  - a second guide track located on said outer surface running parallel to said first hinged edge;
  - a straight cut guide slidably engaged within said first guide track; and,
  - a roof pitch cut guide slidably engaged within said second guide track;
    - wherein both said straight cut guide and said roof pitch cut guide adjustably progress independently at interval adjustments and are designed to assist in guiding said cutting instrument at said varying angle; and,
  - a first pair of resilient stops securably and adjustably placed within opposing ends of said first guide track and a second pair of resilient stops securably and adjustably placed within opposing ends of said second guide track, wherein said first pair of resilient stops and said second pair of resilient stops function to prevent said guides from unwanted slippage down said guide tracks;

a lower plate further comprising:
- a second straight edge;
- a second hinged edge;
- a second open edge with a second lip; and,
- a second roof pitch edge embodying a second varying angle and a second width, wherein said second open edge comprises a greater length than said second hinged edge;

an interior; and, at least one hinged connection, attached to said first hinged edge of said upper plate and said second hinged edge of said lower plate;

wherein said first lip and said second lip abut each other when said upper plate and said lower plate are conjoined thereby defining said interior, said interior encompasses said siding member to be cut.

12. The device of claim 11, wherein said first width and said second width accommodates said siding member with either 8 inches in width or 10 inches in width.

13. The device of claim 12, wherein said first pair and said second pair of resilient stops are either fabricated with a non-slip frictional composition or with mechanical fasteners.

14. The device of claim 13, wherein said device further comprises a fastening:

mechanism situated at a center location of said first and second open edges to fasten said upper plate to said lower plate.

15. The device of claim 14, wherein said first varying angle and said second varying angle is a conventional roof pitch angle, said angle is 4/12, 6/12, or 8/12.

16. A method for cutting a siding member, comprising the steps of:

providing a device for retaining, measuring, and providing a cutting guide for a cutting instrument for a siding member comprising:

an upper plate, further comprising:
- a first straight edge;
- a first hinged edge;
- a first open edge with a first lip;
- a first roof pitch edge embodying a first varying angle, and a first width, wherein said first open edge comprises a greater length than said first hinged edge; and,
- an upper surface comprising:
  - a first guide track located on an outer surface running parallel to said first open edge;
  - a second guide track located on said outer surface running parallel to said first hinged edge;
  - a straight cut guide slidably engaged within said first guide track; and,
  - a roof pitch cut guide slidably engaged within said second guide track;
    - wherein both said straight cut guide and said roof pitch cut guide adjustably progress independently at interval adjustments and are designed to assist in guiding said cutting instrument at said varying angle; and,
  - a first pair of resilient stops securably and adjustably placed within opposing ends of said first guide track and a second pair of resilient stops securably and adjustably placed within opposing ends of said second guide track, wherein said first pair of resilient stops and said second pair of resilient stops function to prevent said guides from unwanted slippage down said guide tracks;

a lower plate further comprising:
- a second straight edge;
- a second hinged edge;
- a second open edge with a second lip; and, a second roof pitch edge embodying a second varying angle and a second width, wherein said second open edge comprises a greater length than said second hinged edge;

an interior; and, at least one hinged connection, attached to said first hinged edge of said upper plate and said second hinged edge of said lower plate;

acquiring said siding member;

measuring a desired angle and marking said angle on said siding member;

obtaining said device with said first and said second varying angle that matches said desired angle;

opening said device about said hinged connection, thereby revealing said interior;

placing said siding member therewithin said interior;

closing said device about said hinged connection, wherein said first lip and said second lip abut each other when said upper plate and said lower plate are conjoined;

encompassing said siding member therewithin said interior such that said siding member extends longitudinally outward;

slidably adjusting said straight cut guide such that a blade of said cutting instrument comes into contact with said siding member;

ensuring said first pair of resilient stops are in place to prevent slippage of said straight cut guide;

cutting said siding member by guiding said cutting instrument along said straight cut guide;

slidably adjusting said roof pitch cut guide such that said blade of said cutting instrument comes into contact with said siding member;

ensuring that said second pair of resilient stops are in place to prevent slippage of said roof pitch cut guide; and, cutting said siding member by guiding said cutting instrument along said roof pitch cut guide.

17. The method of claim 16, further comprising the steps of:

providing a fastening mechanism situated at a center location of said first and second open edges; and, fastening said upper plate to said lower plate, thereby retaining said siding member therewith in.

18. The method of claim 17, further comprising the steps of providing a device wherein said varying angle is 4/12, 6/12, or 8/12.

* * * * *